US010352160B2

(12) United States Patent
Pop et al.

(10) Patent No.: US 10,352,160 B2
(45) Date of Patent: Jul. 16, 2019

(54) METHOD OF ESTIMATING UNCONTAMINATED FLUID PROPERTIES DURING SAMPLING

(71) Applicant: Schlumberger Technology Corporation, Sugar Land, TX (US)

(72) Inventors: Julian Pop, Houston, TX (US); Kentaro Indo, Sugar Land, TX (US); Kai Hsu, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 527 days.

(21) Appl. No.: 14/538,403

(22) Filed: Nov. 11, 2014

(65) Prior Publication Data

US 2015/0211363 A1 Jul. 30, 2015

Related U.S. Application Data

(60) Provisional application No. 61/932,157, filed on Jan. 27, 2014.

(51) Int. Cl.
*E21B 49/08* (2006.01)

(52) U.S. Cl.
CPC ..... *E21B 49/081* (2013.01)

(58) Field of Classification Search
CPC ..... E21B 49/081
USPC ..... 702/12
See application file for complete search history.

(56) References Cited

U.S. PATENT DOCUMENTS

| | | | | |
|---|---|---|---|---|
| 6,956,204 | B2 | 10/2005 | Dong et al. | |
| 8,024,125 | B2 | 9/2011 | Hsu et al. | |
| 2004/0193375 | A1 | 9/2004 | Dong et al. | |
| 2006/0155474 | A1 | 7/2006 | Venkataramanan et al. | |
| 2009/0030858 | A1 | 1/2009 | Hegeman et al. | |
| 2009/0288881 | A1* | 11/2009 | Mullins | E21B 7/04 175/50 |
| 2011/0087459 | A1* | 4/2011 | Zazovsky | E21B 49/10 702/179 |
| 2011/0088895 | A1 | 4/2011 | Pop et al. | |
| 2011/0088949 | A1 | 4/2011 | Zuo et al. | |
| 2014/0180591 | A1* | 6/2014 | Hsu | G01V 11/00 702/8 |
| 2014/0316705 | A1 | 10/2014 | Zuo et al. | |

FOREIGN PATENT DOCUMENTS

WO 2013148442 A1 10/2013

OTHER PUBLICATIONS

Duda, et al., "Use of the Hough Transform to Detect Lines and Curves in Pictures", Communications of the ACM CACM Homepage archive, vol. 15, Issue 1, Jan. 1972, pp. 11-15.

(Continued)

*Primary Examiner* — Long K Tran

(57) ABSTRACT

According to certain embodiments, formation fluid properties, such as gas-oil ratio (GOR), formation volume factor (FVF), and density, may be measured at multiple times during sampling. In one embodiment, data representing the measured properties is analyzed and a characteristic of interest is determined through extrapolation from the analyzed data. Various other methods and systems are also disclosed.

19 Claims, 12 Drawing Sheets

(56) References Cited

OTHER PUBLICATIONS

Hammond, "One or Two Phased Flow During Fluid Sampling by a Wireline Tool", Transport in Porous Media, vol. 6(3), 1991, pp. 299-330.
Hsu, et al., "Multi-Channel Oil-Based Mud Contamination Monitoring Using Downhole Optical Spectrometer", SPWLA 49th Annual Logging Symposium, May 25-28, 2008, 13 pages.
Levache, et al., "Deep Offshore Fluid Evaluation/Connectivity Study", SPE-62904-MS, Society of Petroleum Engineers, SPE Annual Technical Conference and Exhibition, Dallas, Texas, Oct. 1-4, 2000, 11 pgs.
Mullins, et al., "Real-Time Determination of Filtrate Contamination During Openhole Wireline Sampling by Optical Spectroscopy", SPE 63071—SPE Annual Technical Conference and Exhibition, Dallas, Texas, Oct. 2000, pp. 1-13.
Villareal, "Sampling While Drilling: An Emerging Technology", Spe 159503 presented at the SPE Annual Technical Conference and Exhibition held in San Antonio, Texas, Oct. 8-10, 2012, pp. 128-140.
International Search Report and Written Opinion issued in PCT/US2015/013004 dated May 19, 2015, 15 pages.
Gozalpour, et al. "Predicting Reservoir Fluid Phase and Volumetric Behavior From Samples Contaminated with Oil-Based Mud", SPE Reservoir Evaluation & Engineering, Jun. 2002, pp. 197-205.
Hy-Billiot, et al. "Getting the Best from Formation Tester Sampling", SPE 77771, SPE ATCE, San Antonio, Texas, Sep. 29-Oct. 2, 2002, pp. 1-9.
MacMillan, et al. "How to Obtain Reservoir Fluid Properties from an Oil Sample Contaminated with Synthetic Drilling Mud," SPE 38852, SPE ATCE, San Antonio, TX, Oct. 5-8, 1997, pp. 113-123.
O'Keefe, et al. "Focused Sampling of Reservoir Fluids Achieves Undetectable Levels of Contamination," SPE 101084, SPE Asia Pacific Oil & Gas Conference and Exhibition, Adelaide, Australia, Sep. 11-13, 2006, pp. 1-20.
U.S. Appl. No. 14/085,550, filed Nov. 20, 2013.
U.S. Appl. No. 14/085,589, filed Nov. 20, 2013.
U.S. Appl. No. 14/177,744, filed Feb. 11, 2014.
Austad, et al. "Compositional and PVT Properties of Reservoir Fluids Contaminated by Drilling Fluid Filtrate", Journal of Petroleum Science and Engineering, 20, 213-244 (2001).
International Preliminary Report on Patentability issued in related PCT application PCT/US2015/013004 dated Aug. 11, 2016, 12 pages.
Extended Search Report (R. 62 EPC) issued in European Patent Application 15740993.9 dated Nov. 22, 2017, 9 pages.
Examiners Report 94(3) EPC issued in European Patent Application 15740993.9 dated Oct. 22, 2018, 5 pages.
Thomas et al., Deconvolution of Drilling Fluid-Contaminated Oil Samples, Journal of Canadian Petroleum Technology, vol. 44, No. 6, Jun. 2, 2005, pp. 28-35.

* cited by examiner

METHOD OF ESTIMATING UNCONTAMINATED FLUID PROPERTIES DURING SAMPLING

CROSS-REFERENCE TO RELATED APPLICATIONS

This application claims benefit of U.S. Provisional Patent Application Ser. No. 61/932,157, filed Jan. 27, 2014, which is herein incorporated by reference.

BACKGROUND

Wells are generally drilled into subsurface rocks to access fluids, such as hydrocarbons, stored in subterranean formations. The formations penetrated by a well can be evaluated for various purposes, including for identifying hydrocarbon reservoirs within the formations. During drilling operations, one or more drilling tools in a drill string may be used to test or sample the formations. Following removal of the drill string, a wireline tool may also be run into the well to test or sample the formations. These drilling tools and wireline tools, as well as other wellbore tools conveyed on coiled tubing, drill pipe, casing or other means of conveyance, are also referred to herein as "downhole tools." Certain downhole tools may include two or more integrated collar assemblies, each for performing a separate function, and a downhole tool may be employed alone or in combination with other downhole tools in a downhole tool string.

Formation evaluation may involve drawing fluid from the formation into a downhole tool. In some instances, the fluid drawn from the formation is retained within the downhole tool for later testing outside of the well. In other instances, downhole fluid analysis may be used to test the fluid while it remains in the well. Such analysis can be used to provide information on certain fluid properties in real time without the delay associated with returning fluid samples to the surface.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

In one embodiment of the present disclosure, a method includes sampling formation fluid and determining properties of the sampled formation fluid through downhole fluid analysis. The determined properties include first and second properties of the sampled formation fluid determined at multiple sampling times, and the first property varies with contamination of the sampled formation fluid. The method also includes analyzing data representing the determined first and second properties and determining a characteristic of interest of the sampled formation fluid through extrapolation from the analyzed data.

In another embodiment, a method includes sampling formation fluid and determining formation fluid properties for the sampled formation fluid over a range of contamination values. The method also includes analyzing variation within data representing the determined formation fluid properties to identify clusters within the data. A model for estimating clean formation fluid properties can then be developed based on the identified clusters.

In a further embodiment, a downhole tool includes a probe for receiving formation fluid within the downhole tool. The downhole tool also includes a fluid analyzer to determine formation fluid properties for the sampled formation fluid over a range of contamination values. Additionally, the downhole tool includes a controller for analyzing data representing determined formation fluid properties and for developing a model for estimating clean formation fluid properties through extrapolation from the determined formation fluid properties.

Various refinements of the features noted above may exist in relation to various aspects of the present embodiments. Further features may also be incorporated in these various aspects as well. These refinements and additional features may exist individually or in any combination. For instance, various features discussed below in relation to the illustrated embodiments may be incorporated into any of the above-described aspects of the present disclosure alone or in any combination. Again, the brief summary presented above is intended just to familiarize the reader with certain aspects and contexts of some embodiments without limitation to the claimed subject matter.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION OF SPECIFIC EMBODIMENTS

It is to be understood that the present disclosure provides many different embodiments, or examples, for implementing different features of various embodiments. Specific examples of components and arrangements are described below for purposes of explanation and to simplify the present disclosure. These are, of course, merely examples and are not intended to be limiting.

The present disclosure relates to estimating uncontaminated formation fluid properties in substantially real-time based on downhole fluid analysis measurements. According to certain embodiments, formation fluid properties, such as gas-oil ratio (GOR), formation volume factor (FVF), and density may be measured across a range of contamination levels. In one example, the measured properties may be plotted with respect to contamination levels and the data may be filtered and smoothed. The variation in the resulting data may then be employed to fit a contamination model to the data. For example, data clusters may be automatically identified and the model may be developed to include the largest data clusters. Alternately, the range of data over which the model is to be applied may be chosen interactively. The model can then be employed to estimate formation fluid properties at approximately zero contamination.

Figure 1:
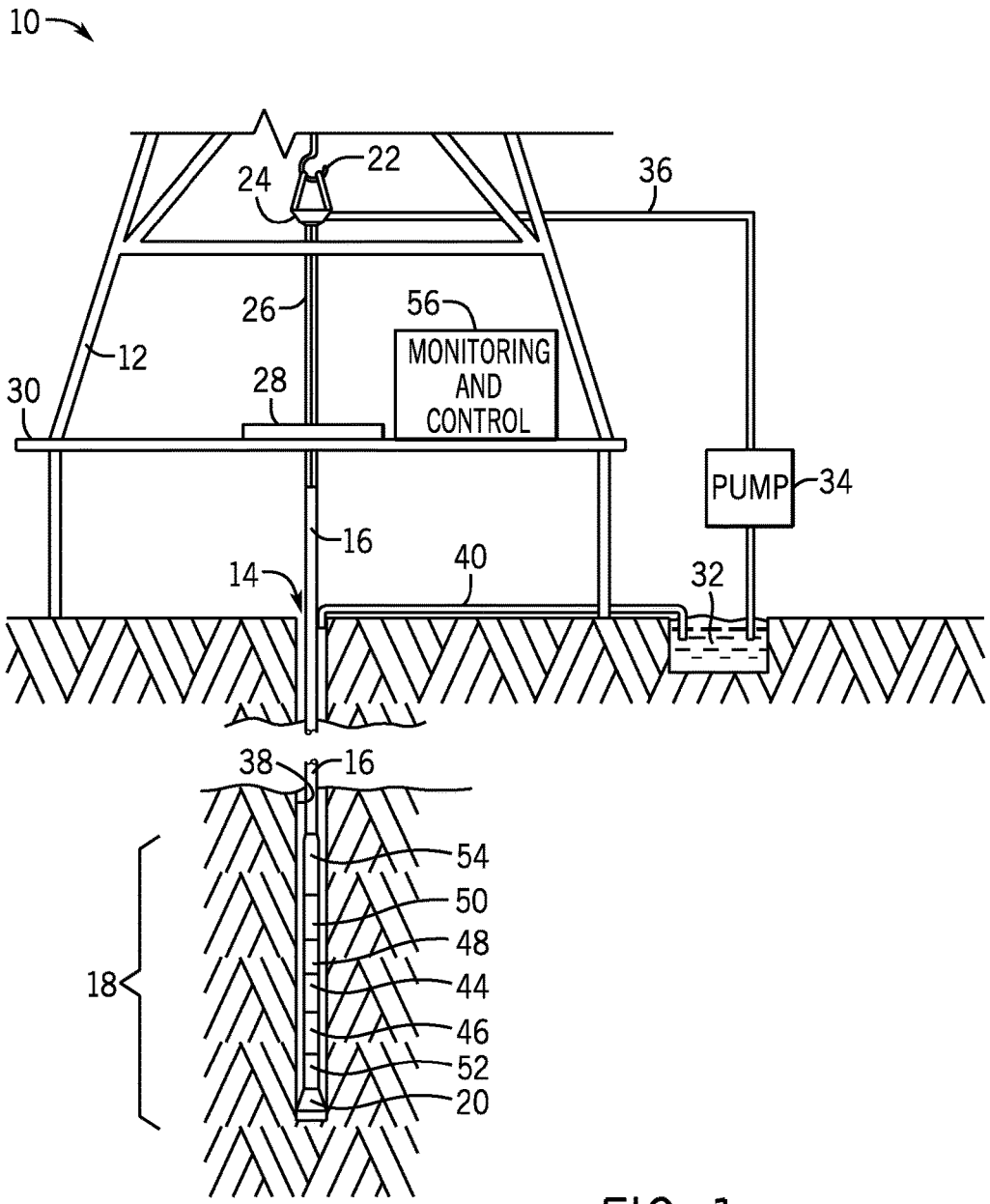
FIG. 1 generally depicts a drilling system having a fluid sampling tool in a drill string in accordance with one embodiment of the present disclosure.

Turning now to the drawings, a drilling system 10 is depicted in FIG. 1 in accordance with one embodiment. While certain elements of the drilling system 10 are depicted in this figure and generally discussed below, it will be appreciated that the drilling system 10 may include other components in addition to, or in place of, those presently illustrated and discussed. As depicted, the system 10 includes a drilling rig 12 positioned over a well 14. Although depicted as an onshore drilling system 10, it is noted that the drilling system could instead be an offshore drilling system. The drilling rig 12 supports a drill string 16 that includes a bottomhole assembly 18 having a drill bit 20. The drilling rig 12 can rotate the drill string 16 (and its drill bit 20) to drill the well 14.

The drill string 16 is suspended within the well 14 from a hook 22 of the drilling rig 12 via a swivel 24 and a kelly 26. Although not depicted in FIG. 1, the skilled artisan will appreciate that the hook 22 can be connected to a hoisting system used to raise and lower the drill string 16 within the well 14. As one example, such a hoisting system could include a crown block and a drawworks that cooperate to raise and lower a traveling block (to which the hook 22 is connected) via a hoisting line. The kelly 26 is coupled to the drill string 16, and the swivel 24 allows the kelly 26 and the drill string 16 to rotate with respect to the hook 22. In the presently illustrated embodiment, a rotary table 28 on a drill floor 30 of the drilling rig 12 is constructed to grip and turn the kelly 26 to drive rotation of the drill string 16 to drill the well 14. In other embodiments, however, a top drive system could instead be used to drive rotation of the drill string 16.

During operation, drill cuttings or other debris may collect near the bottom of the well 14. Drilling fluid 32, also referred to as drilling mud, can be circulated through the well 14 to remove this debris. The drilling fluid 32 may also clean and cool the drill bit 20 and provide positive pressure within the well 14 to inhibit formation fluids from entering the wellbore. In FIG. 1, the drilling fluid 32 is circulated through the well 14 by a pump 34. The drilling fluid 32 is pumped from a mud pit (or some other reservoir, such as a mud tank) into the drill string 16 through a supply conduit 36, the swivel 24, and the kelly 26. The drilling fluid 32 exits near the bottom of the drill string 16 (e.g., at the drill bit 20) and returns to the surface through the annulus 38 between the wellbore and the drill string 16. A return conduit 40 transmits the returning drilling fluid 32 away from the well 14. In some embodiments, the returning drilling fluid 32 is cleansed (e.g., via one or more shale shakers, desanders, or desilters) and reused in the well 14.

In addition to the drill bit 20, the bottomhole assembly 18 also includes various instruments that measure information of interest within the well 14. For example, as depicted in FIG. 1, the bottomhole assembly 18 includes a logging-while-drilling (LWD) module 44 and a measurement-while-drilling (MWD) module 46. Both modules include sensors, housed in drill collars, that collect data and enable the creation of measurement logs in real-time during a drilling operation. The modules could also include memory devices for storing the measured data. The LWD module 44 includes sensors that measure various characteristics of the rock and formation fluid properties within the well 14. Data collected by the LWD module 44 could include measurements of gamma rays, resistivity, neutron porosity, formation density, sound waves, optical density, and the like. The MWD module 46 includes sensors that measure various characteristics of the bottomhole assembly 18 and the wellbore, such as orientation (azimuth and inclination) of the drill bit 20, torque, shock and vibration, the weight on the drill bit 20, and downhole temperature and pressure. The data collected by the MWD module 46 can be used to control drilling operations. The bottomhole assembly 18 can also include one or more additional modules 48, which could be LWD modules, MWD modules, or some other modules. It is noted that the bottomhole assembly 18 is modular, and that the positions and presence of particular modules of the assembly could be changed as desired. Further, as discussed in greater detail below, one or more of the modules 44, 46, and 48 is or includes a fluid sampling tool configured to obtain a sample of a fluid from a subterranean formation and perform downhole fluid analysis to measure properties (e.g., contamination and optical densities) of the sampled fluid.

The bottomhole assembly 18 can also include other modules. As depicted in FIG. 1 by way of example, such other modules include a power module 50, a steering module 52, and a communication module 54. In one embodiment, the power module 50 includes a generator (such as a turbine) driven by flow of drilling mud through the drill string 16. In other embodiments the power module 50 could also or instead include other forms of power storage or generation, such as batteries or fuel cells. The steering module 52 may include a rotary-steerable system that facilitates directional drilling of the well 14. The communication module 54 enables communication of data (e.g., data collected by the LWD module 44 and the MWD module 46) between the bottomhole assembly 18 and the surface. In one embodiment, the communication module 54 communicates via mud pulse telemetry, in which the communication module 54 uses the drilling fluid 32 in the drill string as a propagation medium for a pressure wave encoding the data to be transmitted.

The drilling system 10 also includes a monitoring and control system 56. The monitoring and control system 56 can include one or more computer systems that enable monitoring and control of various components of the drilling system 10. The monitoring and control system 56 can also receive data from the bottomhole assembly 18 (e.g., data from the LWD module 44, the MWD module 46, and the additional module 48) for processing and for communication to an operator, to name just two examples. While depicted on the drill floor 30 in FIG. 1, it is noted that the monitoring and control system 56 could be positioned elsewhere, and that the system 56 could be a distributed system with elements provided at different places near or remote from the well 14.

Figure 2:
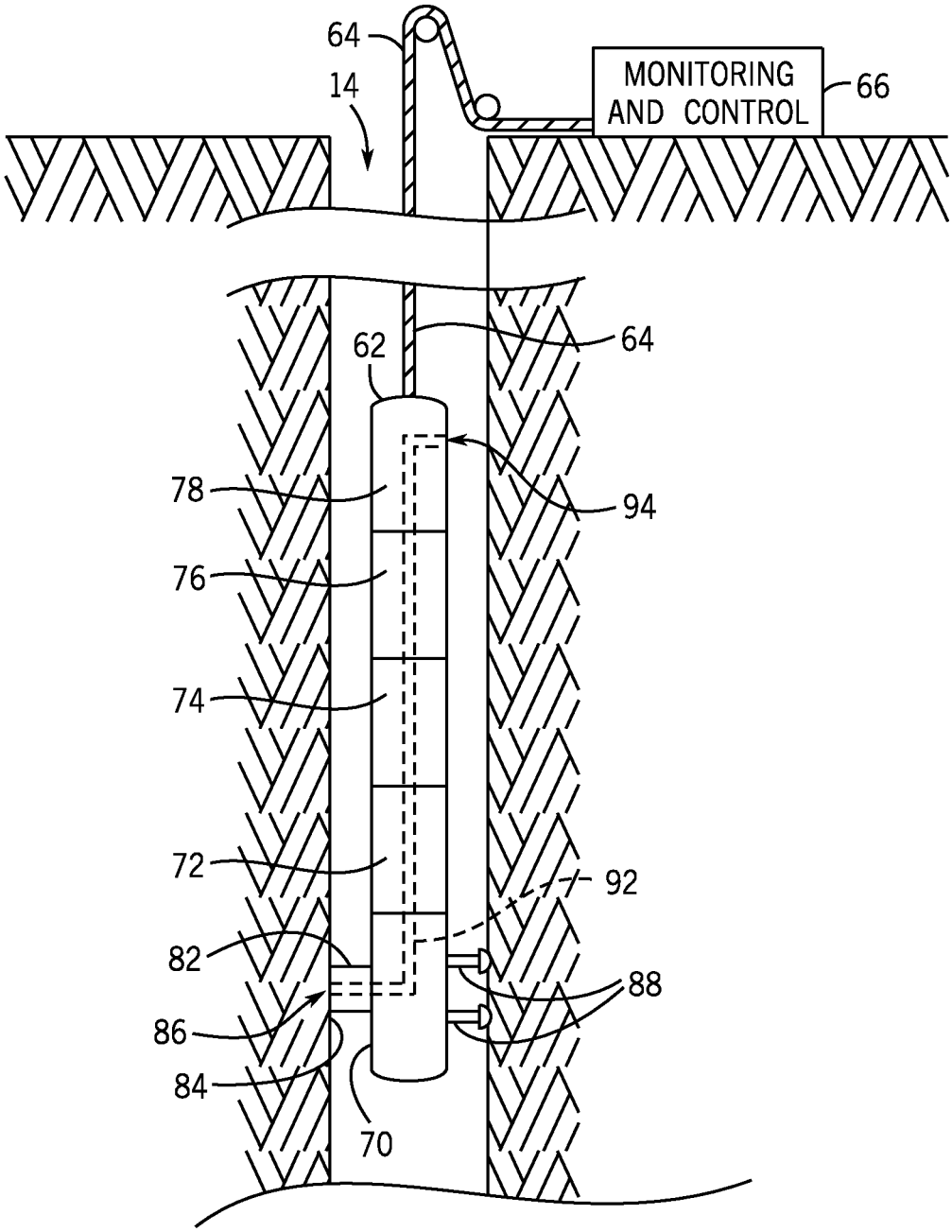
FIG. 2 generally depicts a fluid sampling tool deployed within a well on a wireline in accordance with one embodiment.

Another example of using a downhole tool for formation testing within the well 14 is depicted in FIG. 2. In this embodiment, a fluid sampling tool 62 is suspended in the well 14 on a cable 64. The cable 64 may be a wireline cable with at least one conductor that enables data transmission between the fluid sampling tool 62 and a monitoring and control system 66. The cable 64 may be raised and lowered within the well 14 in any suitable manner. For instance, the cable 64 can be reeled from a drum in a service truck, which may be a logging truck having the monitoring and control system 66. The monitoring and control system 66 controls movement of the fluid sampling tool 62 within the well 14 and receives data from the fluid sampling tool 62. In a similar fashion to the monitoring and control system 56 of FIG. 1, the monitoring and control system 66 may include one or more computer systems or devices and may be a distributed computing system. The received data can be stored, communicated to an operator, or processed, for instance. While the fluid sampling tool 62 is here depicted as being deployed by way of a wireline, in some embodiments the fluid sampling tool 62 (or at least its functionality) is incorporated into or as one or more modules of the bottom-hole assembly 18, such as the LWD module 44 or the additional module 48.

The fluid sampling tool 62 can take various forms. While it is depicted in FIG. 2 as having a body including a probe module 70, a fluid analysis module 72, a pump module 74, a power module 76, and a fluid storage module 78, the fluid sampling tool 62 may include different modules in other embodiments. The probe module 70 includes a probe 82 that may be extended (e.g., hydraulically driven) and pressed into engagement against a wall 84 of the well 14 to draw fluid from a formation into the fluid sampling tool 62 through an intake 86. As depicted, the probe module 70 also includes one or more setting pistons 88 that may be extended outwardly to engage the wall 84 and push the end face of the probe 82 against another portion of the wall 84. In some embodiments, the probe 82 includes a sealing element or packer that isolates the intake 86 from the rest of the wellbore. In other embodiments the fluid sampling tool 62 could include one or more inflatable packers that can be extended from the body of the fluid sampling tool 62 to circumferentially engage the wall 84 and isolate a region of the well 14 near the intake 86 from the rest of the wellbore. In such embodiments, the extendable probe 82 and setting pistons 88 could be omitted and the intake 86 could be provided in the body of the fluid sampling tool 62, such as in the body of a packer module housing an extendable packer.

The pump module 74 draws the sampled formation fluid into the intake 86, through a flowline 92, and then either out into the wellbore through an outlet 94 or into a storage container (e.g., a bottle within fluid storage module 78) for transport back to the surface when the fluid sampling tool 62 is removed from the well 14. The fluid analysis module 72 includes one or more sensors for measuring properties of the sampled formation fluid, such as the optical density of the fluid, and the power module 76 provides power to electronic components of the fluid sampling tool 62.

The drilling and wireline environments depicted in FIGS. 1 and 2 are examples of environments in which a fluid sampling tool may be used to facilitate analysis of a down-hole fluid. The presently disclosed techniques, however, could be implemented in other environments as well. For instance, the fluid sampling tool 62 may be deployed in other manners, such as by a slickline, coiled tubing, or a pipe string.

Figure 3:
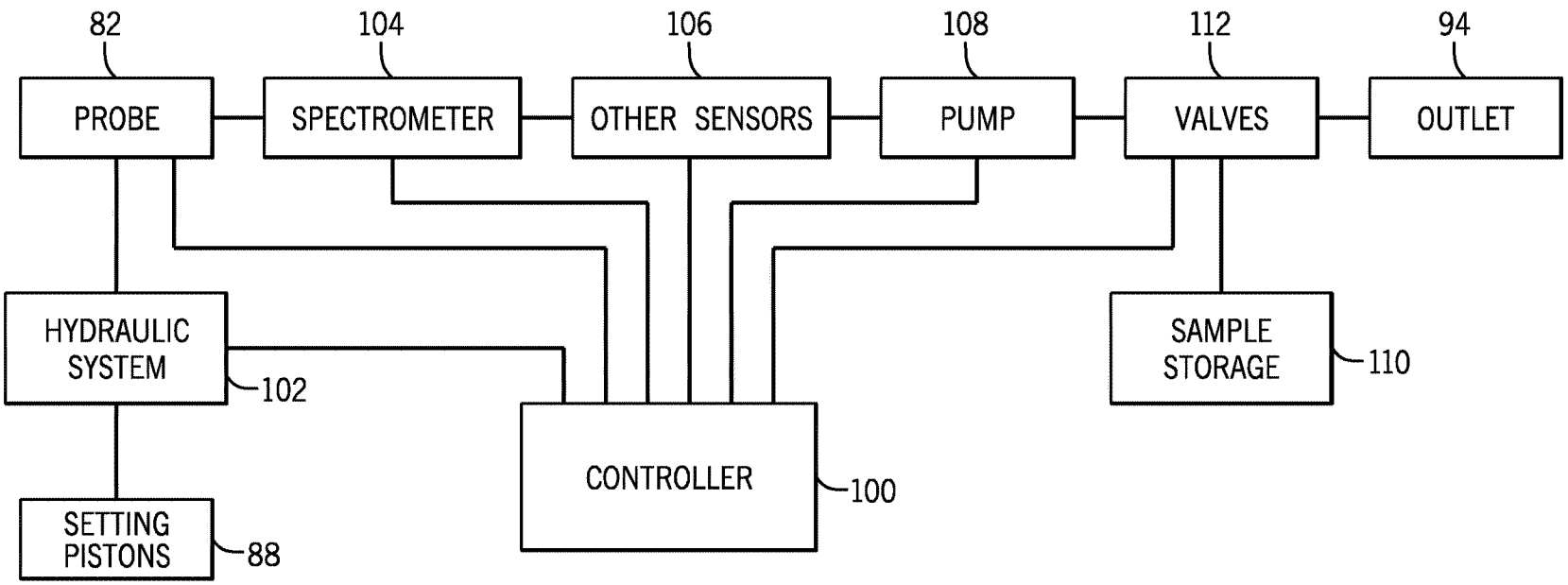
FIG. 3 is a block diagram of components of a fluid sampling tool operated by a controller in accordance with one embodiment.

Additional details as to the construction and operation of the fluid sampling tool 62 may be better understood through reference to FIG. 3. As shown in this figure, various components for carrying out functions of the fluid sampling tool 62 are connected to a controller 100. The various components include a hydraulic system 102 connected to the probe 82 and the setting pistons 88, a spectrometer 104 for measuring fluid optical properties, one or more other sensors 106, a pump 108, and valves 112 for diverting sampled fluid into storage devices 110 rather than venting it through the outlet 94.

In operation, the hydraulic system 102 extends the probe 82 and the setting pistons 88 to facilitate sampling of a formation fluid through the wall 84 of the well 14. It also retracts the probe 82 and the setting pistons 88 to facilitate subsequent movement of the fluid sampling tool 62 within the well. The spectrometer 104, which can be positioned within the fluid analysis module 72, collects data about optical properties of the sampled formation fluid. Such measured optical properties can include optical densities (absorbance) of the sampled formation fluid at different wavelengths of electromagnetic radiation. Using the optical densities, the composition of a sampled fluid (e.g., weight or mole fractions of its constituent components) can be determined. Other sensors 106 can be provided in the fluid sampling tool 62 (e.g., as part of the probe module 70 or the fluid analysis module 72) to take additional measurements related to the sampled fluid. In various embodiments, these additional measurements could include pressure and temperature, density, viscosity, electrical resistivity, saturation pressure, and fluorescence, to name several examples. Other characteristics, such as GOR, can also be determined using the measurements.

Any suitable pump 108 may be provided in the pump module 74 to enable formation fluid to be drawn into and pumped through the flowline 92 in the manner discussed above. Storage devices 110 for formation fluid samples can include any suitable vessels (e.g., bottles) for retaining and transporting desired samples within the fluid sampling tool 62 to the surface. Both the storage devices 110 and the valves 112 may be provided as part of the fluid storage module 78.

In the embodiment depicted in FIG. 3, the controller 100 facilitates operation of the fluid sampling tool 62 by controlling various components. Specifically, the controller 100 directs operation (e.g., by sending command signals) of the hydraulic system 102 to extend and retract the probe 82 and the setting pistons 88 and of the pump 108 to draw formation fluid samples into and through the fluid sampling tool. The controller 100 also receives data from the spectrometer 104 and the other sensors 106. This data can be stored by the controller 100 or communicated to another system (e.g., the monitoring and control system 56 or 66) for analysis. In some embodiments, the controller 100 is itself capable of analyzing the data it receives from the spectrometer 104 and the other sensors 106. The controller 100 also operates the valves 112 to divert sampled fluids from the flowline 92 into the storage devices 110.

Figure 4:
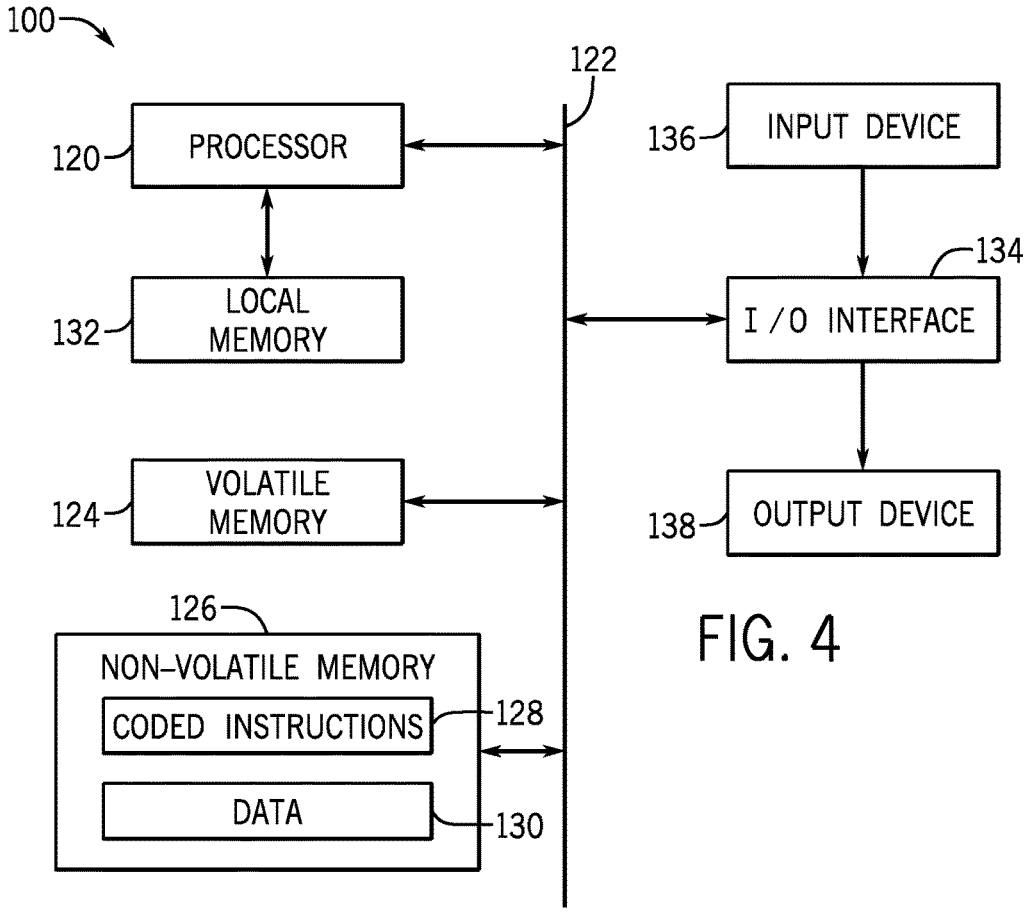
FIG. 4 is a block diagram of components in one example of the controller illustrated in FIG. 3.

The controller 100 in some embodiments is a processor-based system, an example of which is provided in FIG. 4. In this depicted embodiment, the controller 100 includes at least one processor 120 connected, by a bus 122, to volatile memory 124 (e.g., random-access memory) and non-volatile memory 126 (e.g., flash memory and a read-only memory (ROM)). Coded application instructions 128 (e.g., software that may be executed by the processor 120 to enable the control and analysis functionality described herein) and data 130 are stored in the non-volatile memory 126. For example, the application instructions 128 can be stored in a ROM and the data can be stored in a flash memory. The instructions 128 and the data 130 may be also be loaded into the volatile memory 124 (or in a local memory 132 of the processor) as desired, such as to reduce latency and increase operating efficiency of the controller 100.

An interface 134 of the controller 100 enables communication between the processor 120 and various input devices 136 and output devices 138. The interface 134 can include any suitable device that enables such communication, such as a modem or a serial port. In some embodiments, the input devices 136 include one or more sensing components of the fluid sampling tool 62 (e.g., the spectrometer 104) and the output devices 138 include displays, printers, and storage devices that allow output of data received or generated by the controller 100. Input devices 136 and output devices 138 may be provided as part of the controller 100, although in other embodiments such devices may be separately provided.

The controller 100 can be provided as part of the monitoring and control systems 56 or 66 outside of a well 14 to enable downhole fluid analysis of samples obtained by the fluid sampling tool 62. In such embodiments, data collected by the fluid sampling tool 62 can be transmitted from the well 14 to the surface for analysis by the controller 100. In some other embodiments, the controller 100 is instead provided within a downhole tool in the well 14, such as within the fluid sampling tool 62 or in another component of the bottomhole assembly 18, to enable downhole fluid analysis to be performed within the well 14. Further, the controller 100 may be a distributed system with some components located in a downhole tool and others provided elsewhere (e.g., at the surface of the wellsite).

Whether provided within or outside the well 14, the controller 100 can receive data collected by the sensors within the fluid sampling tool 62 and process this data to determine one or more characteristics of the sampled fluid. Examples of such characteristics include fluid type, GOR, formation volume factor, hydrocarbon composition, carbon dioxide content, asphaltene content, compressibility, saturation pressure, water content, density, viscosity, and contamination level.

Some of the data collected by the fluid sampling tool 62 relates to optical properties (e.g., optical densities) of a sampled fluid measured by the spectrometer 104. To facilitate measurements, in some embodiments the spectrometer 104 may be arranged about the flowline 92 of the fluid sampling tool 62 in the manner generally depicted in FIG. 5. In this example, the spectrometer 104 includes an emitter 142 of electromagnetic radiation, such as a light source, and a detector 144 disposed about the flowline 92 in the fluid sampling tool 62. A light source provided as the emitter 142 can be any suitable light-emitting device, such as one or more light-emitting diodes or incandescent lamps. As used herein, the term "visible light" is intended to mean electromagnetic radiation within the visible spectrum, and the shorter term "light" is intended to include not just electromagnetic radiation within the visible spectrum, but also infrared and ultraviolet radiation.

Figure 5:
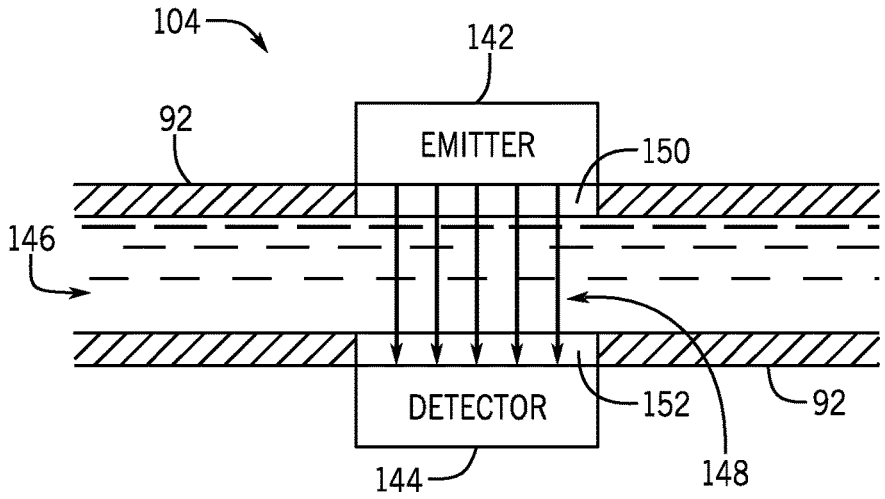
FIG. 5 generally depicts a spectrometer positioned about a flowline to enable measurement of an optical property of a fluid within the flowline in accordance with one embodiment.

In operation, a sampled formation fluid 146 within the flowline 92 is irradiated with electromagnetic radiation 148 (e.g., light) from the emitter 142. The electromagnetic radiation 148 includes radiation of any desired wavelengths within the electromagnetic spectrum. In some embodiments, the electromagnetic radiation 148 has a continuous spectrum within one or both of the visible range and the short- and near-infrared (SNIR) range of the electromagnetic spectrum, and the detector 144 filters or diffracts the received electromagnetic radiation 148. The detector 144 may include a plurality of detectors each assigned to separately measure light of a different wavelength. As depicted in FIG. 5, the flowline 92 includes windows 150 and 152 that isolate the emitter 142 and the detector 144 from the sampled formation fluid 146 while still permitting the electromagnetic radiation 148 to be transmitted and measured. As will be appreciated, some portion of the electromagnetic radiation 148 is absorbed by the sampled fluid 146, and the extent of such absorption varies for different wavelengths and sampled fluids. The optical density of the fluid 146 at one or more wavelengths may be determined based on data from the spectrometer 104 by comparing the amount of radiation emitted by the emitter 142 and the amount of that radiation received at detector 144. It will be appreciated that the optical density (also referred to as the absorbance) of a fluid at a given wavelength is calculated as the base-ten logarithm of the ratio of electromagnetic radiation incident on the fluid to that transmitted through the fluid for the given wavelength.

The spectrometer 104 may include any suitable number of measurement channels for detecting different wavelengths, and may include a filter-array spectrometer or a grating spectrometer. For example, in some embodiments the spectrometer 104 is a filter-array absorption spectrometer having sixteen measurement channels. In other embodiments, the spectrometer 104 may have ten channels or twenty channels, and may be provided as a filter-array spectrometer or a grating spectrometer. Further, as noted above, the data obtained with the spectrometer 104 can be used to determine optical densities of sampled fluids.

In accordance with the present disclosure, the systems described above can be used to estimate uncontaminated formation fluid properties based on downhole fluid analysis of formation fluid samples. As described further below, the measured fluid properties can be plotted as a function of the estimated level of contamination by mud filtrate. The variation in the measured fluid properties over a range of contamination levels can then be employed to develop a model that predicts fluid properties at levels of approximately zero contamination. In some embodiments, the estimates of uncontaminated fluid properties may enable differentiation between fluids in different zones. Further, the estimates may provide information about uncontaminated fluid properties when no sample recovery is possible.

Figure 6:
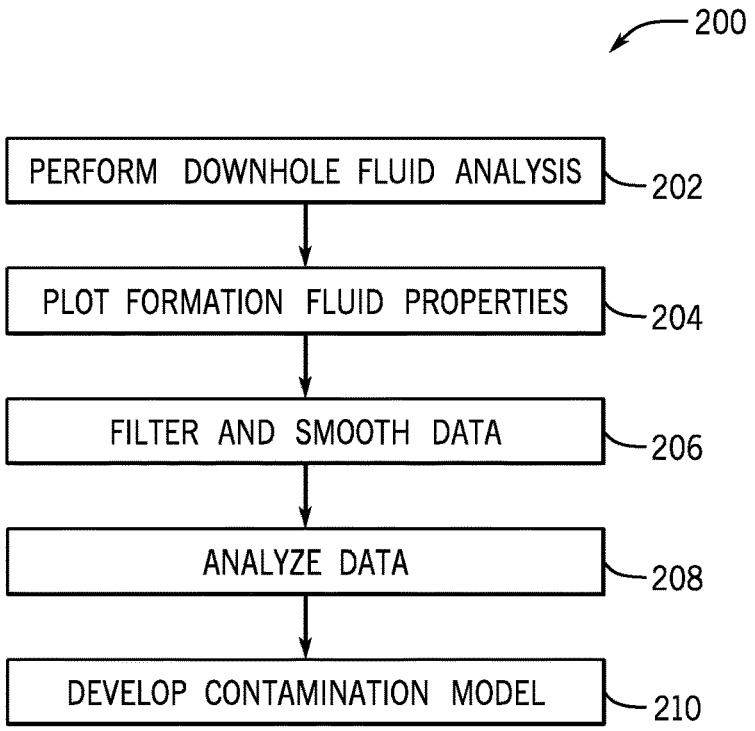
FIG. 6 is a flowchart depicting a method for estimating uncontaminated formation fluid properties, according to aspects of the present disclosure.

FIG. 6 is a flowchart depicting an embodiment of a method 200 that may be employed to estimate uncontaminated formation fluid properties. According to certain embodiments, the method 200 may be executed, in whole or in part, by the controller 100 (FIG. 3). For example, the controller 100 may execute code stored within circuitry of the controller 100, or within a separate memory or other tangible readable medium, to perform the method 200. In certain embodiments, the method 200 may be wholly executed while the downhole tool is disposed within a wellbore. Further, in certain embodiments, the controller 100 may operate in conjunction with a surface controller, such as the processing system 56 or 66 (FIGS. 1 and 2), that may perform one or more operations of the method 200.

The method 200 may begin by performing (block 202) downhole fluid analysis on formation fluids. For instance, a fluid sampling tool of either the drilling system or wireline system described above with respect to FIGS. 1 and 2 (e.g., fluid sampling tool 62) can be used to sample reservoir fluid at one or more measurement stations within a wellbore (e.g., the well 14) and analyze the sampled fluids downhole (e.g., at each measurement station). More specifically, a formation fluid can be drawn into the fluid sampling tool and analyzed while the tool is positioned at a depth (or station) within the well to determine a set of formation fluid characteristics. The pump 108 can be operated to draw formation fluid into the downhole tool over a period of time, with formation fluid properties being determined at various time or pumped-volume intervals. Such downhole fluid analysis enables in situ determinations of numerous characteristics of the sampled fluids in real time, including density, viscosity, saturation pressure, reservoir pressure, reservoir temperature, compressibility, temperature gradient, GOR, optical density, mass composition, asphaltene onset pressure, and true vertical depth (of the measurement station at which the fluid was sampled), among others. Discrete amounts of the sampled formation fluid could be retained in the fluid sampling tool for transport to the surface, but the present techniques can be used in a scanning process for analyzing formation fluid without retaining samples for delivery to the surface.

As the formation fluid is drawn into the pump, the level of contamination (e.g., mud filtrate) within the formation fluid may decrease. Accordingly, the formation fluid properties may be measured at different levels of contamination. The level of contamination corresponding to each set of formation fluid properties (e.g., those measured at different times or pumped volumes) may be determined according to techniques known to those skilled in the art. For example, oil base mud (OBM) contamination levels may be estimated using techniques described in SPE paper 63071 titled, "Real-Time Determination of Filtrate Contamination During Openhole Wireline Sampling by Optical Spectrometry," and SPE paper 159503 titled "Sampling While Drilling: An Emerging Technology," both of which are incorporated herein by reference in their entirety.

One or more of the formation fluid properties, such as GOR, saturation pressure (e.g., bubble point pressure), density, viscosity, FVF, asphaltene content, resistivity, conductivity, compressibility, or composition, among others, may be plotted (block 204) against the contamination level. Further, in certain embodiments, the one or more formation fluid properties may also or instead be plotted (block 204) directly against the optical density (or some other parameter), rather than the contamination level. According to certain embodiments, a plot of the formation fluid properties versus contamination or optical density may be generated by the controller 100, as shown for example in FIGS. 7-12. However, in other embodiments, the controller 100 may develop a virtual plot, for example, where the relationship between the formation fluid properties and contamination or optical density is stored in a tabular format or other data set. In additional embodiments, the controller 100 may actually or virtually generate plots of formation fluid properties against sampling times or sampled fluid volumes, as shown for example in FIGS. 13 and 14.

The data may then be filtered and smoothed (block 206). For example, a de-spiking filter, such as a median filter, may be applied to the formation fluid property data to remove outliers. Further, a smoothing filter, such as a second-order Savitsky-Golay filter, may be applied to the de-spiked formation fluid property data. By employing such a filter in two steps, one may simultaneously estimate the standard deviation of the noise in the data, define an interval consisting of four standard deviations over which to perform the smoothing, and estimate the derivative of the smoothed property with respect to the contamination. (In simple terms, a second order polynomial centered about the point of interest may be fit to the formation fluid property data. The smoothed value is then the constant term and the slope is the linear term in the contamination or optical density.)

The filtered and smoothed data (or the raw data in some instances) may be analyzed to identify trends in the data, and characteristics of interest of the sampled formation fluid (e.g., a characteristic of interest of uncontaminated ("clean") sampled formation fluid) can be determined through extrapolation from the data. In at least some embodiments, this can include fitting a function to the data that describes a relationship between two variables (also known as curve fitting). This curve fitting can be performed in any suitable manner. Further, the curves can be fit to a full data set or a subset of the data, and the curve fitting can be done automatically (e.g., by the downhole sampling tool) or with user input (e.g., with a user selecting a data subset to which a curve is to be fit). In some cases, an initial curve fitting can be done automatically, subject to review and possible overriding by a user. For instance, the downhole sampling tool can perform an initial curve fitting and transmit parameters of the curve fitting and the measurement data to the surface. A surface operator can identify a trend in the data and compare the operator-identified trend to the initial, automatic curve fit to the data for quality control and possible correction. In further embodiments, data collected by a downhole sampling tool can be transmitted to the surface and the curve fitting can be performed at the surface (e.g., with user interaction). Non-limiting examples of the characteristics of interest of the sampled formation fluid that could be extrapolated from the data include GOR, FVF, asphaltene content, compressibility, composition, conductivity, resistivity, saturation pressure, and live fluid density.

By way of example, in one embodiment, for instance, the data is statistically analyzed (block 208) to identify the largest data clusters. For instance, assuming that the trend being sought is linear in the contamination or optical density domains, a histogram of the slopes may be constructed to find the bin with the largest population such that the slope is less than a small negative value, for example 0.1, and its absolute value is less than a prescribed value. According to certain embodiments, a maximum number of fifty bins for data having a frequency of 4 Hz may be employed. The points belonging to the bin with the largest population may then be identified. From these identified points, the data whose indices form the largest cluster may be identified (e.g., the "maximal" cluster). In certain embodiments, the points belonging to the bin with the largest number of data may be spread throughout the data in clusters of not necessarily contiguous points.

A contamination model may then be developed (block 210) to estimate the formation fluid properties at approximately a zero contamination level. For example, a line (or some other curve) may be fit to the points belonging to the "maximal" cluster found in block 208. The line may then be extrapolated to zero contamination, and the ordinate at zero contamination will be the estimate of the clean formation fluid property. Where optical density is employed rather than contamination, extrapolation of the desired fluid property trend may be performed up to the end-point value and not to zero.

Although the above procedure has been framed in terms of linear extrapolation, in principle, other forms of extrapolation can be employed, for example, polynomial or exponential extrapolation or, better still, extrapolation according to a known physical model. The specific details of the algorithm however may change.

The above outlined procedure has been found effective in analyzing sampling-while-drilling data, as described below with respect to FIGS. 7-12. However, other procedures for determining the optimal extrapolation line may also be employed, such as the Hough transform, which can be adapted to recognizing and fitting trends in data.

Although the example of the application of the method 200 described above is for the case where a full data set has been acquired from sampling at a station and is in memory, it should be realized that the procedure is applicable during the process of acquisition. During acquisition, the data up to the current time is used, the procedure is applied and the clean fluid property is estimated by extrapolation to zero contamination. As more data is acquired, the extrapolated values should converge to an almost constant value, the variation being reflective of the uncertainty in the property value.

Figure 7:
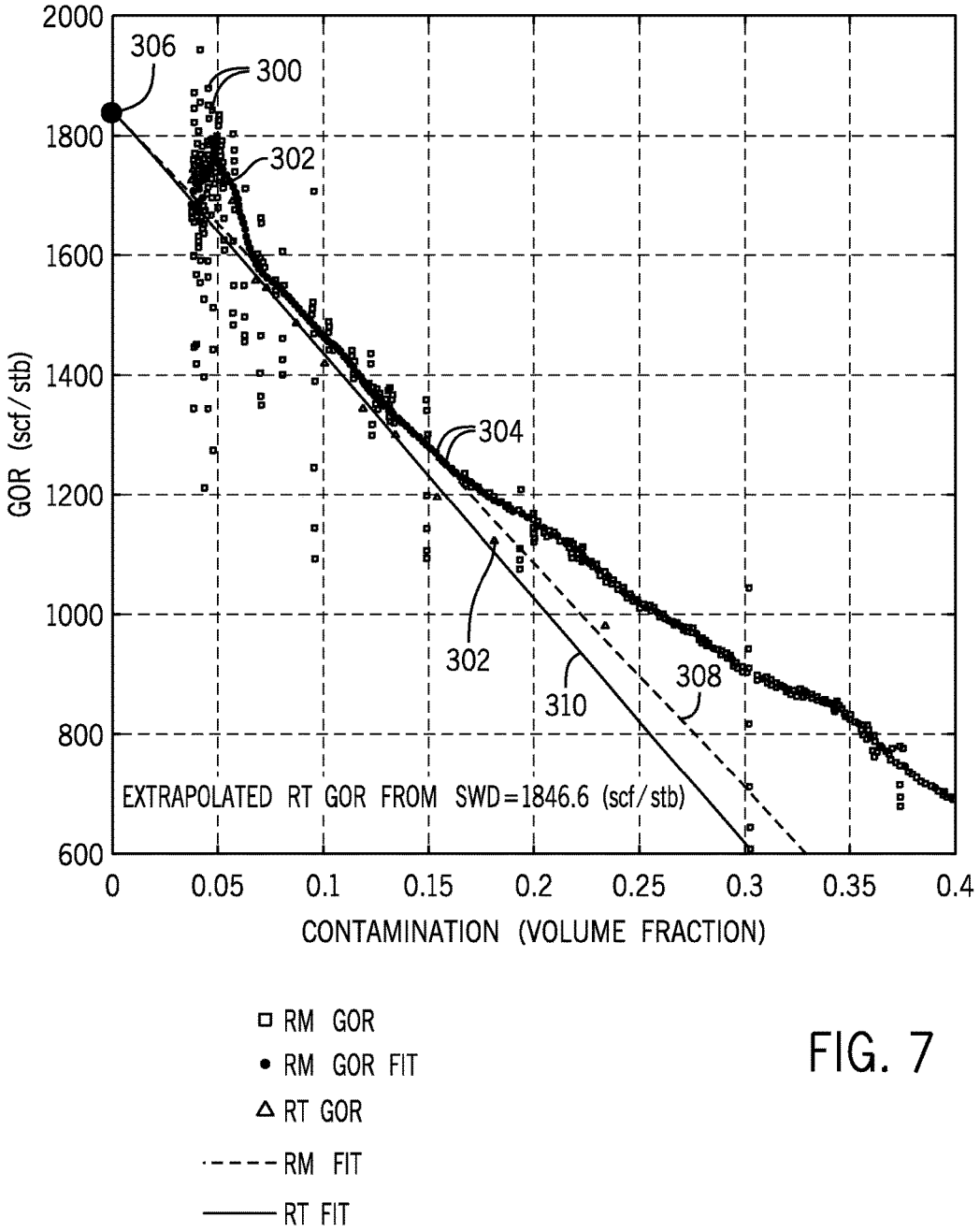
Figure 8:
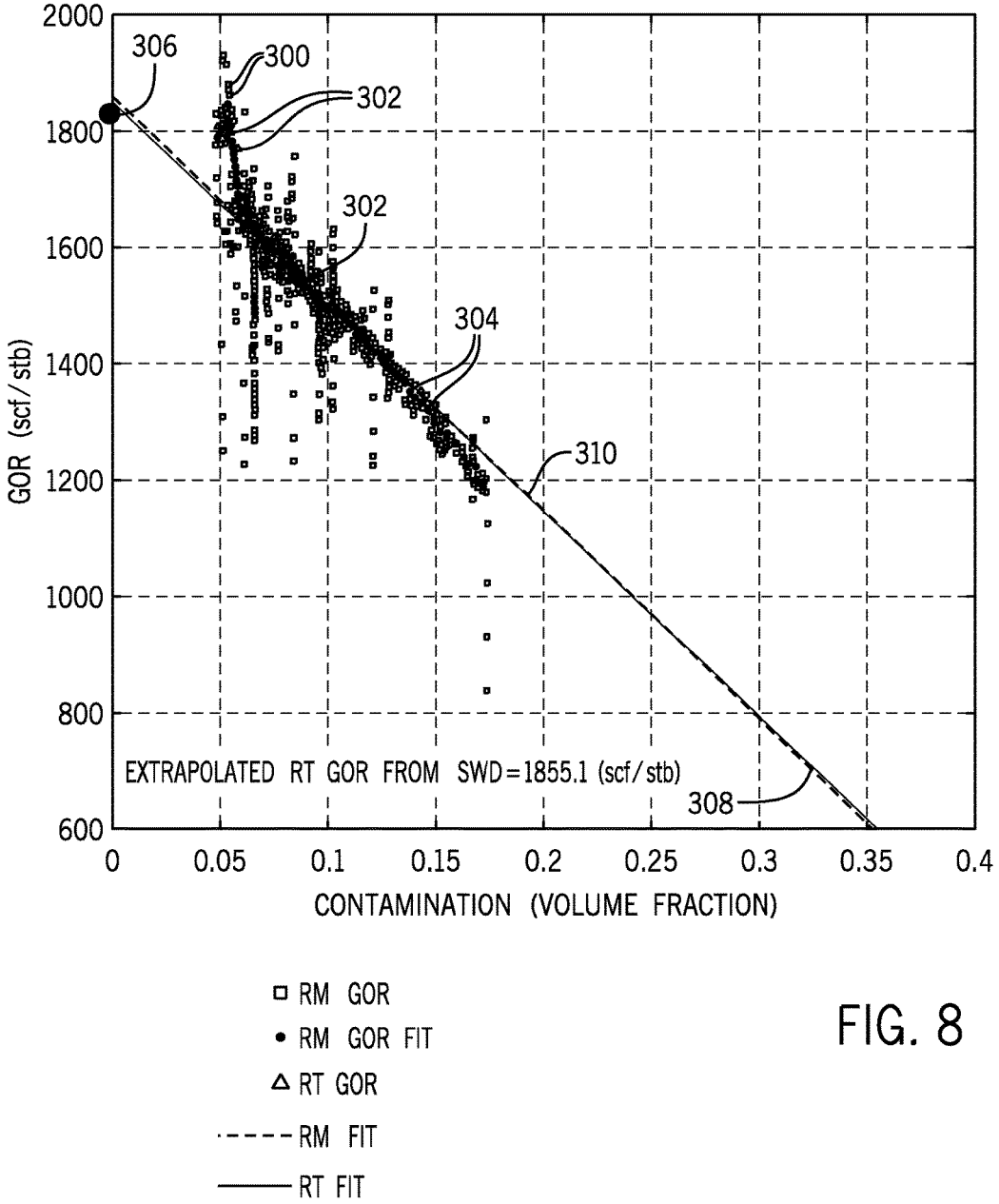

FIGS. 7-12 depict examples of contamination models developed employing the techniques described herein. FIGS. 7 and 8 depict estimates of clean GOR determined by plotting the measured GOR values over a range of contamination levels. The points 300 represent the measured GOR data (e.g., determined from the compositions) plotted against the contamination, where the GOR and contamination data is retrieved from the memory of the downhole tool. The points 302 represent the GORs determined from the compositions determined by the tool and transmitted to surface (e.g., in real-time) plotted against contamination values determined at surface during the test. The points 304 are derived from the data represented by the points 300 by applying a 13-point median filter. The line 308 represents the modeled contamination developed from the points 304, and the line 310 represents the modeled contamination developed from the points 302. The larger point 306 represents the PVT laboratory estimated GOR derived using cleaned fluid composition and an equation of state. As shown in FIGS. 7 and 8, a close correlation exists between the PVT laboratory GOR value for uncontaminated formation fluid and the ordinate representing the estimated clean formation fluid GOR value obtained using the contamination models 308 and 310.

Figure 9:
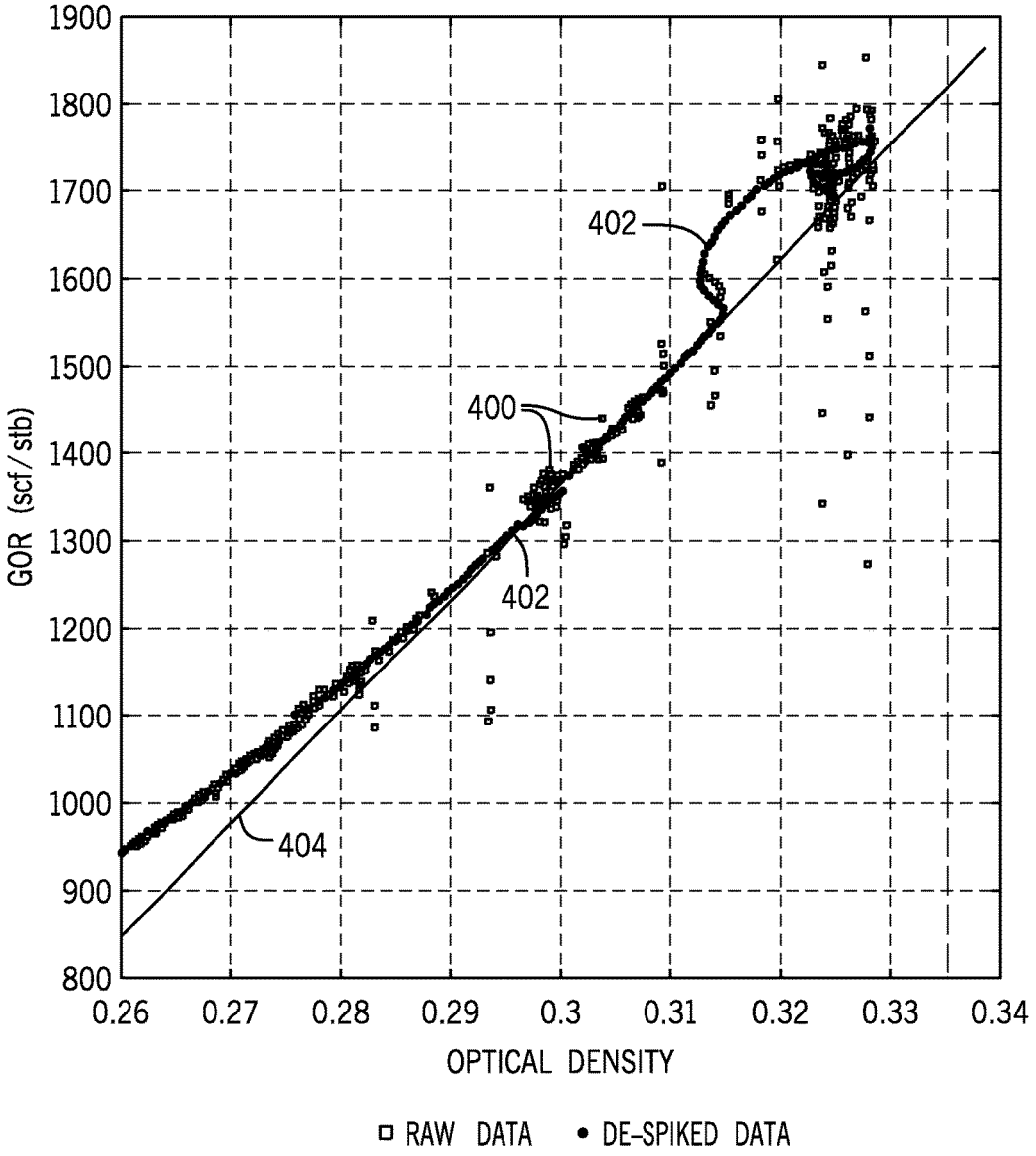
Figure 10:
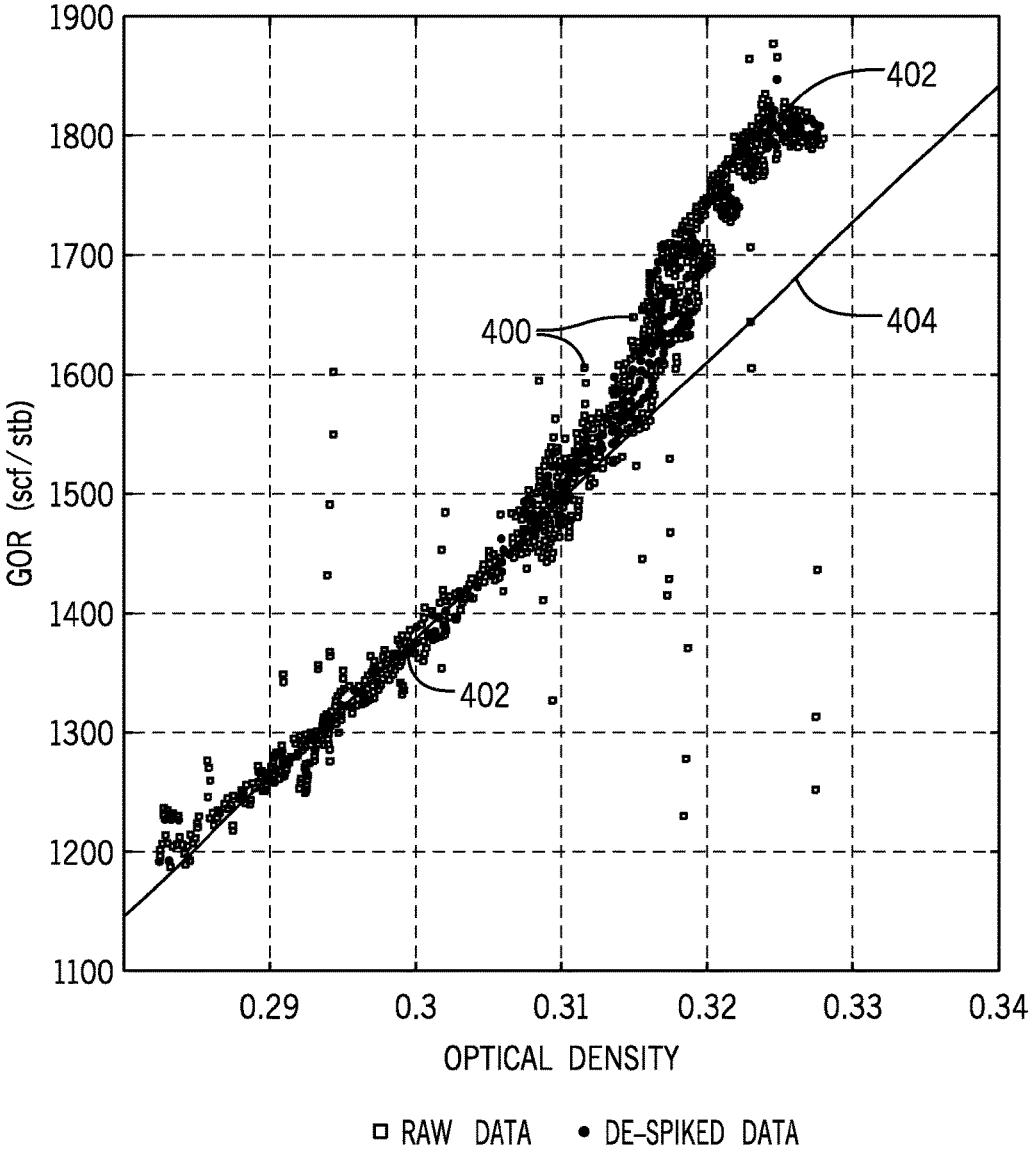

FIGS. 9 and 10 depict estimates of clean GOR determined by plotting the measured GOR values over a range of optical densities corresponding to different contamination levels. The points 400 represent the measured GOR data plotted against the optical densities. The points 402 represent the de-spiked data obtained by filtering the points 400. The line 404 represents the resulting contamination model. For the embodiment shown in FIG. 9, the end-point optical density was found to be 0.335 which corresponds to a "clean" GOR of slightly above 1800 scf/stb, a value in close agreement with that previously estimated in FIG. 7 and the laboratory measured value. For the embodiment shown in FIG. 10, the end-point optical density was found to be 0.341 which corresponds to a "clean" GOR of slightly above 1840 scf/stb, a value in close agreement with that previously estimated in FIG. 8 and the laboratory measured value. In these two figures, the GOR is plotted against optical densities of the sampled fluid for a single wavelength. It will be appreciated, however, that the GOR could be plotted against optical densities of the sampled fluid for multiple wavelengths.

Figure 11:
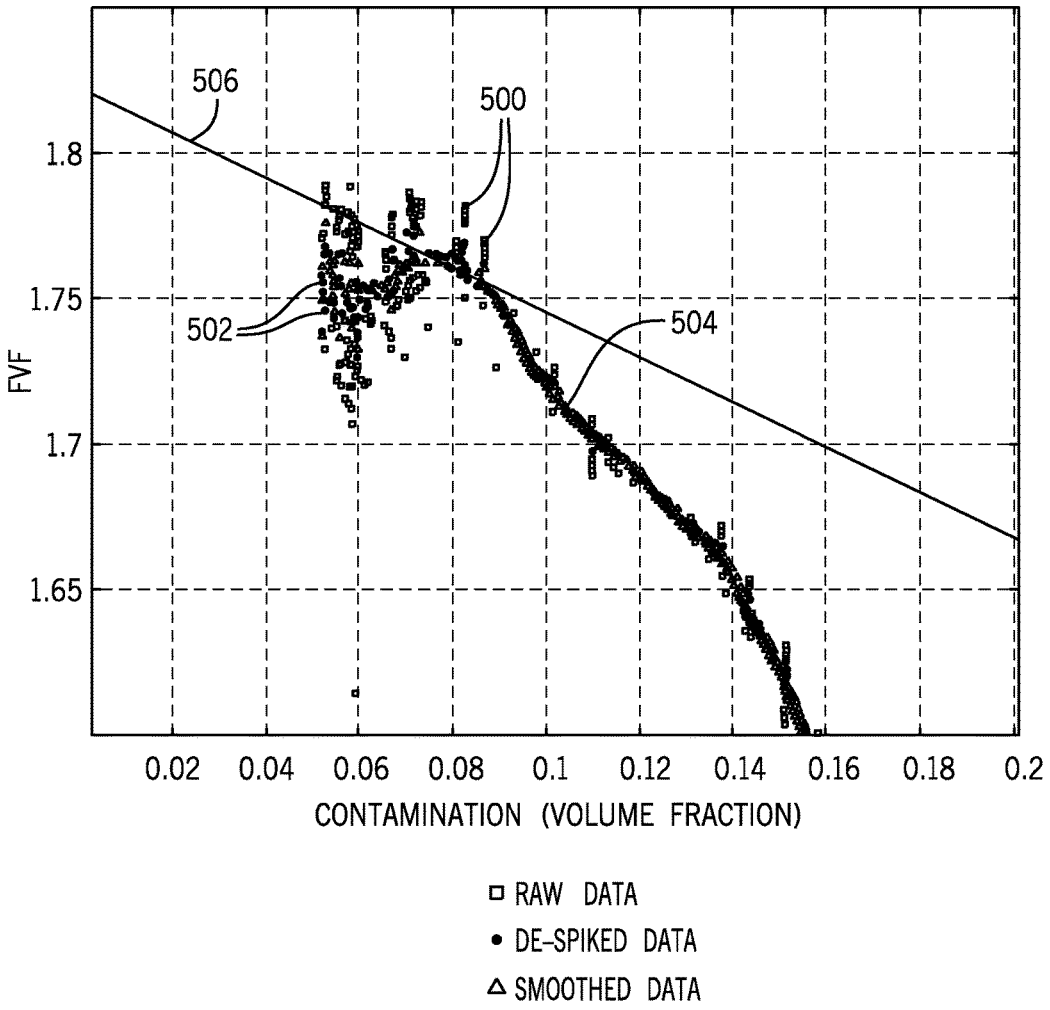
Figure 12:
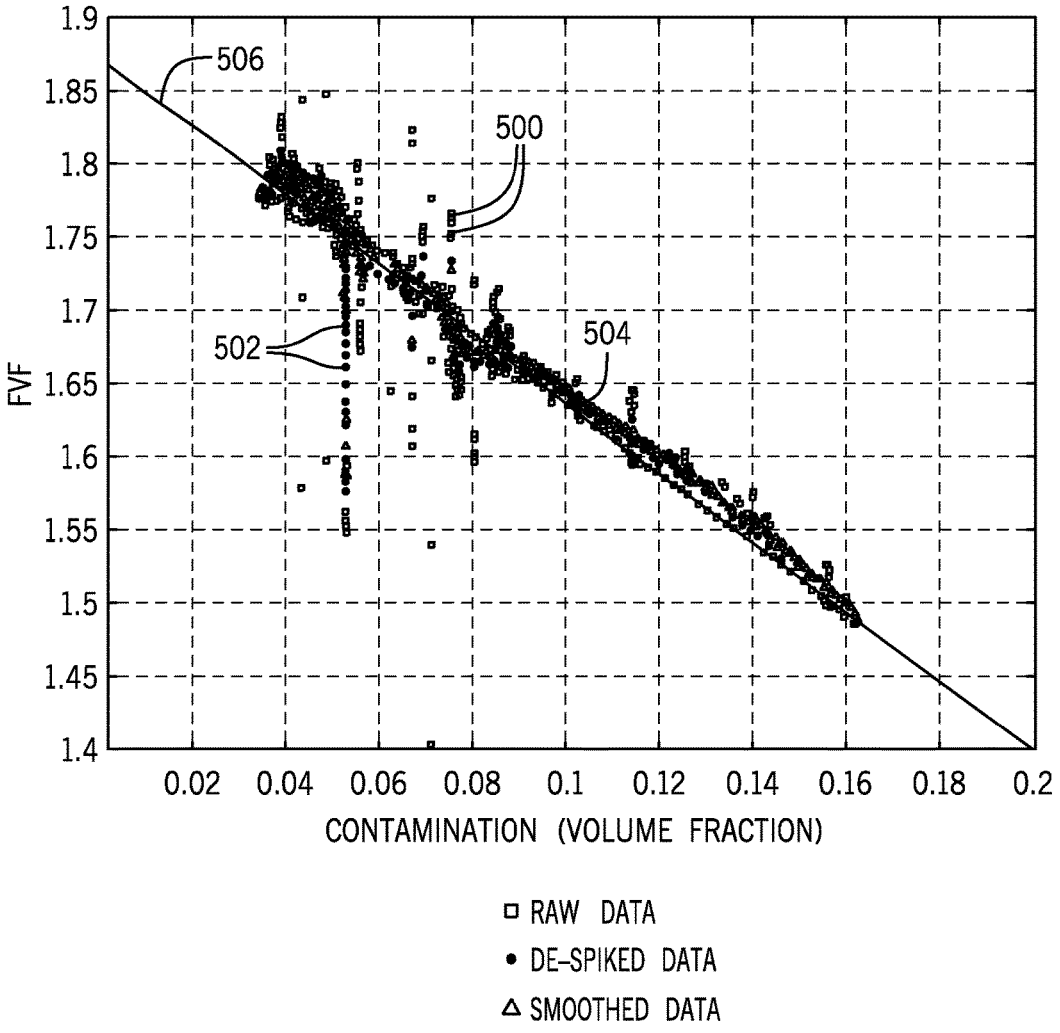

FIGS. 11 and 12 depict estimates of clean FVF determined by plotting measured FVF values over a range of contamination levels. The points 500 represent the measured FVF data plotted against the contamination. The points 502 represent the de-spiked data obtained from the points 500. The points 504 represent the smoothed data from which slopes can be calculated, and the line 506 represents the contamination model. The estimated clean FVF values of about 1.82 (FIG. 11) and 1.87 (FIG. 12) are in fair agreement with the laboratory measured values.

Figure 13:
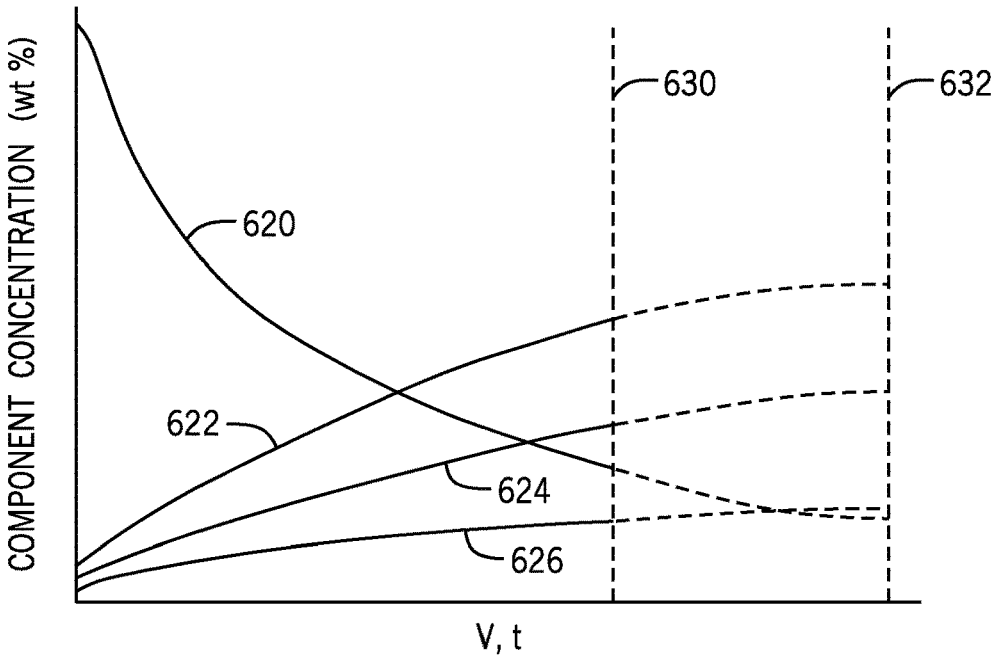

As a further example, FIG. 13 generally depicts an estimated composition of clean formation fluid through extrapolation from composition data for the sampled formation fluid acquired at different times (which may be represented by either time (t) or the volume (V) of fluid pumped by the tool during a sampling process). More specifically, a downhole tool can analyze sampled formation fluid from a measurement station at multiple times to determine various properties, such as the levels (i.e., amounts) of different components (e.g., C1, C2, C3, C4, C5, C6, C7+, and CO2) in the fluid at those times. Curves can then be fit to the resulting data representing the amounts of the different components. Examples of such curves are shown in FIG. 13 as curves 620, 622, 624, and 626, but it will be appreciated that the number of curves can vary depending on the number of components considered. For instance, eight curves could be fit to the data when considering the levels of C1, C2, C3, C4, C5, C6, C7+, and CO2 in the sampled formation fluid.

As described above, the curve fitting could be performed automatically (e.g., within the downhole tool or at the surface) or with user input. The composition of the fluid can be measured over a range of contamination levels during sampling. In some instances, the composition data acquired by the downhole tool during sampling can be smoothed and filtered, such as described above. Dashed line 630 is provided in FIG. 13 to generally indicate the time or pumped volume of the latest measurement of the composition used for analysis. The portions of the curves fit to the data that extend beyond that time or pumped volume (shown as dashed portions in FIG. 13) end at dashed line 632, which can represent a time or pumped volume corresponding to clean formation fluid (e.g., at time infinity or at infinite pumped volume). These extrapolated, end-point values of the curves at the dashed line 632 would then represent the amounts of the different components for clean formation fluid at the measurement station. Additional characteristics of interest (e.g., GOR, FVF, or asphaltene content) could then be calculated based on the determined composition of the clean formation fluid.

Figure 14:
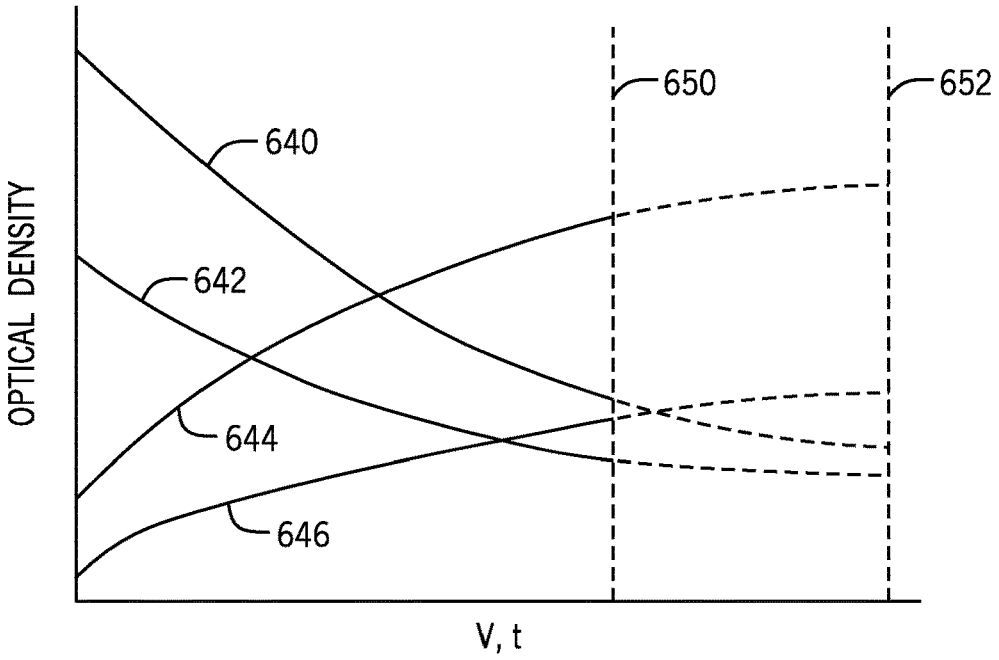

As another example, FIG. 14 generally depicts estimated optical densities of clean formation fluid for different wavelengths of light through extrapolation from measured optical density data for the sampled formation fluid. As similarly described above with respect to composition data and FIG. 13, a downhole tool can analyze the sampled formation fluid at different times during sampling (e.g., as contamination of the fluid is decreasing) to measure the optical densities of fluid for various wavelengths of light. Curves can then be fit to the acquired data (e.g., raw data, filtered data, or filtered and smoothed data), with each curve describing the optical density of the fluid for a particular wavelength over time or pumped volume. Several examples of such curves are depicted in FIG. 14 as curves 640, 642, 644, and 646, but the number of such curves can vary with the number of wavelengths considered. In some embodiments, optical densities of the sampled formation fluid can be measured for ten or twenty wavelengths.

Figure 15:
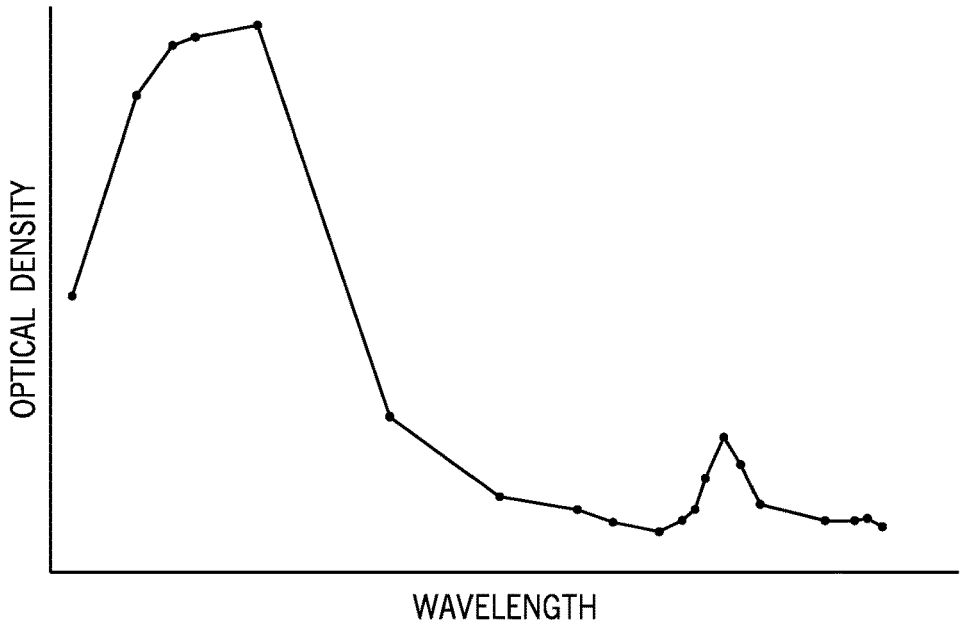
FIGS. 7-15 are graphs depicting estimated clean formation fluid properties, according to aspects of the present disclosure.

Again, the curves could be fit to the acquired data automatically or with user input. Dashed line 650 represents the time or pumped volume of the latest measurement of optical densities by the downhole tool during a sampling process at a measurement station, and dashed line 652 represents a later time or pumped volume, such as a time or pumped volume corresponding to clean formation fluid (e.g., at time infinity or at infinite pumped volume). The extrapolated, end-point values of the curves at the dashed line 652 then represent the optical densities of clean formation fluid at the measurement station. The values of the optical densities at infinite pumped volume or time can come from the model used to describe evolution of the optical density over pumped volume or time. For example, the form of one model used to fit the optical density data can be:

$$OD(V)=OD(V_I)-bV^{-a},$$

where OD(V) is the optical density of the sampled fluid for a pumped volume V, a and b are fitting parameters, and $OD(V_I)$ is the optical density of the sampled fluid at infinite pumped volume. It will be appreciated that a, b, and $OD(V_I)$ can be constants estimated during the fitting process, and that a similar model can be employed for estimating other fluid properties of clean formation fluid. The optical densities of the clean formation fluid for different wavelengths can be used to estimate the optical spectrum of the clean formation fluid, such as generally depicted in FIG. 15 (showing, as an example, data points representing estimated optical densities of clean formation fluid for twenty wavelengths). The optical spectrum, in turn, can be used to determine other characteristics of interest for the clean formation fluid. The estimated optical spectrum for the clean formation fluid can also be used to estimate the optical spectrum of mud filtrate.

The foregoing outlines features of several embodiments so that those skilled in the art may better understand aspects of the present disclosure. Those skilled in the art should appreciate that they may readily use the present disclosure as a basis for designing or modifying other processes and structures for carrying out the same purposes or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The invention claimed is:

1. A method comprising:

operating a downhole sampling tool in a well in a geological formation, wherein the well or the geological formation, or both, contains a formation fluid that comprises a reservoir fluid of the geological formation and a contaminant, and wherein the downhole sampling tool comprises one or more sensors configured to measure a plurality of fluid properties of the formation fluid;

drawing the formation fluid using the downhole sampling tool; and using a processor to:

determine the plurality of fluid properties for the drawn formation fluid at multiple times through downhole fluid analysis using the downhole sampling tool, wherein the plurality of fluid properties includes gas-to-oil ratio (GOR), formation volume factor (FVF), and optical density;

plot the at least one other fluid property of the plurality of fluid properties over a range of optical densities of the drawn formation fluid measured over time, wherein each optical density in the range of optical densities corresponds to a different contamination level, and wherein the contamination level is representative of an amount of the contaminant present in the drawn formation fluid;

identify a trend in the data as measured by the downhole sampling tool based on a relationship between the optical density and the at least one other fluid property of the plurality of fluid properties; and estimate one or more fluid properties of the reservoir fluid based on the trend through extrapolation of the data representing the optical density and the at least one other fluid property of the formation fluid, wherein the reservoir fluid is uncontaminated formation fluid.

2. The method of claim 1, wherein the one or more fluid properties of the reservoir fluid comprise a compressibility, composition, asphaltene content, conductivity, resistivity, saturation pressure, viscosity, or live fluid density of the reservoir.

3. The method of claim 1, comprising fitting a curve to at least a portion of the data representing the optical density and the at least one other fluid property to identify the trend.

4. The method of claim 3, wherein the one or more fluid properties of the reservoir fluid is estimated from the curve fit to the data.

5. The method of claim 4, wherein the curve fit to the data describes the at least one other fluid property as a function of the optical density.

6. The method of claim 5, wherein the at least one fluid property of the reservoir fluid includes compressibility, composition, asphaltene content, conductivity, resistivity, saturation pressure, viscosity, or live fluid density for the clean formation fluid.

7. The method of claim 3, comprising fitting multiple curves to at least a portion of the data to identify the trend.

8. The method of claim 7, wherein the multiple curves fit to the data represent amounts of different components within the sampled drawn formation fluid over pumped volume.

9. The method of claim 8, wherein the one or more fluid properties include the amounts of the different components of the clean formation fluid.

10. The method of claim 8, comprising determining through extrapolation of the amounts of the different components of the clean formation fluid.

11. The method of claim 7, wherein the multiple curves fit to the data represent the optical densities of the drawn formation fluid for different wavelengths over pumped volume.

12. The method of claim 11, wherein determining the one or more fluid properties of the reservoir fluid through extrapolation from the data includes estimating an optical spectrum for the clean formation fluid and determining the characteristic from the estimated optical spectrum.

13. A method comprising:

operating a downhole sampling tool in a well in a geological formation, wherein the well or the geological formation, or both, contains a formation fluid that comprises a reservoir fluid of the geological formation and a contaminant, and wherein the downhole sampling tool comprises one or more sensors configured to measure a plurality of fluid properties of the formation fluid;

drawing the formation fluid using the downhole sampling tool; and using a processor to:

determine formation fluid properties for the drawn formation fluid over a range of contamination values, wherein the formation fluid properties comprise optical density and one other fluidly property;

analyze variation within data representing the formation fluid properties to identify clusters within the data;

develop a contamination model for estimating fluid properties of the reservoir fluid based on the identified clusters; and estimate the fluid properties of the reservoir fluid by extrapolating the data belonging to a maximal cluster in the identified clusters, wherein the reservoir fluid is uncontaminated formation fluid.

14. The method of claim 13, wherein the plurality of formation fluid properties comprise live fluid density, composition, optical density, asphaltene content, conductivity, or saturation pressure.

15. The method of claim 13, fitting a trend through the maximal cluster to develop the contamination model.

16. The method of claim 13, comprising plotting the formation fluid properties over the optical density.

17. The method of claim 13, comprising filtering and smoothing the data to analyze variation within the data.

18. The method of claim 17, comprising constructing a histogram based on the filtering and smoothing results to identify clusters.

19. A downhole tool comprising:

a probe configured to receive formation fluid drawn from a hydrocarbon reservoir, wherein the formation fluid comprises a reservoir fluid and a contaminant;

a fluid analyzer comprising one or more sensors and configured to measure formation fluid properties for the drawn formation fluid over a range of contamination values, wherein the formation fluid properties comprises optical density of the sampled formation fluid; and a controller operable to:

plot data representing at least one formation fluid property of the measured formation fluid properties as a function of the optical density over a range of optical densities measured over time, wherein each optical density in the range of optical densities corresponds to a different contamination level, and wherein the contamination level is representative of an amount of the contaminant present in the drawn formation fluid;

identify trends in the data based on a relationship between the at least one formation fluid property of the measured formation fluid properties and the optical density;

develop a contamination model configured to estimate clean formation fluid properties based on the trends in the data, wherein the clean formation fluid is substantially free of the contaminant; and estimate the clean formation fluid properties through extrapolation from the data representing the formation fluid properties of the drawn formation fluid.

* * * * *